US006969445B1

(12) United States Patent
Hibino et al.

(10) Patent No.: US 6,969,445 B1
(45) Date of Patent: Nov. 29, 2005

(54) INK JET RECORDING PAPER

(75) Inventors: Yoshihiko Hibino, Tokyo (JP); Koji Idei, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/673,567

(22) PCT Filed: Apr. 12, 1999

(86) PCT No.: PCT/JP99/01938

§ 371 (c)(1),
(2), (4) Date: Oct. 18, 2000

(87) PCT Pub. No.: WO99/54145

PCT Pub. Date: Oct. 28, 1999

(30) Foreign Application Priority Data

Apr. 21, 1998 (JP) ..... 10-110906

(51) Int. Cl.[7] ..... B41M 5/00
(52) U.S. Cl. ..... 162/164.6; 162/168.2; 428/32.21; 428/32.28; 428/32.3; 428/32.31
(58) Field of Search ..... 425/195, 211, 409; 428/195, 32.21, 52.3, 32.28, 32.31, 32.3; 162/168.2, 164.6

(56) References Cited

U.S. PATENT DOCUMENTS

| | | | | |
|---|---|---|---|---|
| 4,620,197 A | | 10/1986 | Miyamoto et al. | 346/2.2 |
| 4,944,988 A | * | 7/1990 | Yasuda et al. | |
| 5,656,379 A | | 8/1997 | Koide et al. | |
| 5,677,067 A | | 10/1997 | Kojima et al. | |
| 5,756,151 A | | 5/1998 | Koide et al. | |
| 5,853,540 A | * | 12/1998 | Niemoller et al. | 428/32.21 |
| 5,882,755 A | * | 3/1999 | Igarashi et al. | |
| 6,174,056 B1 | * | 1/2001 | Sakaki et al. | |

FOREIGN PATENT DOCUMENTS

| | | |
|---|---|---|
| EP | 0 745 488 A1 | 12/1996 |
| JP | 61014979 | 1/1986 |
| JP | 61047290 | 3/1986 |
| JP | 03218885 | 9/1991 |
| JP | 6-143798 | 5/1994 |
| JP | 8-99459 | 4/1996 |
| JP | 8-337045 | 12/1996 |

OTHER PUBLICATIONS

European Search Report dated May 22, 2003.

* cited by examiner

*Primary Examiner*—Pamela R. Schwartz
(74) *Attorney, Agent, or Firm*—Armstrong, Kratz, Quintos, Hanson & Brooks, LLP

(57) ABSTRACT

The object of the present invention is to provide an ink jet recording paper of so-called plain paper type having no coating of pigment on the recording surface which is excellent in image density and color reproducibility of the recorded image and besides has a water resistance of the printed portion. According to the present invention, there is provided an ink jet recording paper which comprises a neutral base paper comprising a wood pulp as a main starting material on which is coated a coating solution containing a fluorescent brightening agent, a water-soluble binder and a cationic polymer fixing agent and in which the coated paper has an ISO whiteness of not less than 95% and a fluorescence intensity of 7–15% measured by a method specified in JIS P-8148 using a xenon flash lamp as a light source. In the ink jet recording paper, preferably, the base paper is made using calcium carbonate as a filler and the ash content of the base paper is adjusted to 5–20% by a specific treatment, and a specific fluorescent brightening agent and a specific cationic polymer fixing agent are contained at a specific mixing ratio.

5 Claims, No Drawings

INK JET RECORDING PAPER

TECHNICAL FIELD

The present invention relates to an ink jet recording paper for recording in color using a water-soluble ink. More particularly, it relates to an ink jet recording paper of so-called plain paper type which has no coating of pigment on the recording surface; and especially, to an ink jet recording paper which is improved in image density of recorded images and color reproducibility by enhancing ISO brightness with a fluorescent brightening agent and is excellent in water resistance of printed portions and surface strength.

BACKGROUND ART

The ink jet recording system directly ejects an ink onto a recording paper and is lower in running cost than conventional recording apparatuses and is noticed as a recording method which causes little noise and can easily perform color recording. From the points of safety and printing characteristics, an aqueous ink is used in such recording system. Furthermore, the recording papers used are demanded to have the following characteristics, i.e., they are high in ink absorption and even when ink dots of different color overlap each other, cause no overflow of the ink; spread of ink dots is proper; shape of dots is close to true circle; the dot edge is sharp; and naturally ink dots have a high density and the papers have a sufficiently high ISO whiteness for making distinct the contrast of dot in color recording.

As recording papers used for the ink jet recording system which meet the above conventional demands, it has been proposed to use the exclusive coated papers as disclosed in JP-A-59-35977 and JP-A-1-135682. On the other hand, in the fields of mono-chromatic recording and business color recording, it is desired to use inexpensive and general purpose recording papers, namely, plain papers generally used in the field or electrophotographic recording apparatuses.

When toner transfer papers which are neutral papers and recently becoming main recording papers used in electrophotographic recording apparatuses are used as recording papers for ink jet recording systems, fillers to be used in base papers are restricted, and there are not obtained recording papers which are better in color reproducibility in color recording and higher in ISO whiteness as compared with coated papers exclusively used for full color ink jet recording. Furthermore, the so-called plain paper type ink jet recording papers having no coating of pigments on the recording surface have a principal point in possibility of ink jet recording and are not improved at all in water resistance which is a problem in ink jet recording system.

The object of the present invention is to improve the conventional problems in the above technical field, and it relates to an ink jet recording paper of so-called plain paper type which has no coating of pigment on the recording surface. That is, the object is to provide an ink jet recording paper which is excellent in surface strength and, especially, in water resistance of images recorded thereon and is high in image density of the recorded images and in color reproducibility by enhancing ISO whiteness.

DISCLOSURE OF INVENTION

The above object is attained by the following inventions.

That is, the ink jet recording paper of the first invention is an ink jet recording paper which is obtained by coating a coating solution containing a fluorescent brightening agent, a water-soluble binder and a cationic polymer fixing agent as main components on a neutral base paper comprising a wood pulp as a main constitutive material and in which the coated paper has an ISO whiteness of not less than 95% and a fluorescence intensity of 7–15% measured by a method specified in JIS P-8148 using a xenon flash lamp as a light source.

The ink jet recording paper of the second invention is the ink jet recording paper of the first invention in which the neutral base paper is made using calcium carbonate as a filler and ash content of the base paper is 5–20% measured in the same manner as specified in JIS P-8126, except that the incineration treatment is carried out at 500° C. for 4 hours.

The ink jet recording paper of the third invention is the ink jet recording paper of the first invention in which the fluorescent brightening agent in the coating solution is a diaminostilbene-disulfonic acid derivative (A) and the cationic polymer fixing agent is a polyvinyl alcohol-cation monomer graft polymer (B), and mixing ratio A:B in solid coating amount is 1:6–2:3.

Furthermore, in the ink jet recording papers of the first, second and third inventions, the coating solution is preferably coated using an on-machine size press of a paper making machine.

Moreover, in the ink jet recording papers of the first, second, third and fourth inventions, preferably the wood pulp contains a waste paper pulp.

Best Mode for Carrying Out the Invention

The ink jet recording paper of the present invention will be explained in detail below.

The inventors firstly investigated the relation between ISO whiteness of the ink jet recording paper and printing characteristics thereof in an ink jet recording apparatus.

The ink jet recording papers of plain paper type have no ink absorbing layer as of so-called coated paper type, and thus the base paper is used as an ink absorbing layer. Therefore, the whiteness of the base paper affects the printing characteristics of the ink jet recording paper. The whiter the base paper is, the higher the contrast of the printed image, and thus the quality of the printed image is improved.

However, since conventional evaluation of whiteness employs the Hunter whiteness specified in JIS P-8123, the whiteness of a sample containing a fluorescent brightening agent often does not agree with visual whiteness of the sample. This is because the Hunter whiteness is measured by illuminating a light which has passed through a blue filter from a filament type lamp, and a light of wavelength region which excites a fluorescent brightening agent (mainly a light of ultraviolet region) is considerably cut. The ISO whiteness is measured by diffusion illuminating a white light of illumination light source using an integrating sphere. If a xenon flash lamp is used as the illumination light source, this includes a light of wavelength region which excites a fluorescent brightening agent and, hence, numerical expression close to visual whiteness becomes possible.

As a result of investigation making comparison on the relation between ISO whiteness of the ink jet recording paper and printing characteristics thereof in an ink jet recording apparatus, there has been recognized a good correlation between the ISO whiteness of a sample and the printing characteristics, especially, image density after printing and image reproducibility. That is, it has been found that when the ISO whiteness of a recording paper used in an ink jet recording apparatus is not less than 95%, the image density and the image reproducibility when printed by an ink jet recording apparatus are well balanced, and thus the ink let recording paper of the present invention has been accomplished.

For the improvement of only the visual whiteness, the following method may be employed. That is, pulp fibers are colored in bluish purple color which is a complement of yellow color by the bluing of sample which has been widely carried out, thereby erasing the remaining yellow color to render nearly colorless, or, in some case, further bluing is carried out to give illusions to visual sense as if the whiteness has been improved. However, according to these methods, lightness considerably lowers.

In order to improve printing characteristics of the ink jet recording paper, it is necessary to enhance the ISO whiteness to not less than 95% using a fluorescent brightening agent. Since the fluorescent brightening agent on the pulp fibers has the property of absorbing ultraviolet light contained in the daylight to emit fluorescence of 400–500 nm, reflected light of shorter wavelength side of the visible part is supplemented to perform bluing without causing decrease of lightness. As a result, the whiteness is further improved when seen with naked eye. Therefore, the brightening with fluorescent brightening agents is different from the bleaching which chemically removes colored substances and dirt from materials. As a result, there can be obtained conspicuous brightening effect which cannot be attained by bleaching.

In color ink jet recording papers, when the ISO whiteness is less than 95%, the visual whiteness is insufficient and quality of prints is of poor image reproducibility. Therefore, considering the printing characteristics and visual whiteness of the ink jet recording paper in printing, the ISO whiteness is preferably 95% or more.

Methods for improving the ISO whiteness include selection of materials high in whiteness as starting materials for paper making and, besides, application of fluorescent brightening agents in view of the above-mentioned mechanism. As to the amount of the fluorescent brightening agent to be added, the larger amount provides higher effect, but the effect is gradually saturated to cause finally a phenomenon of over-dying, resulting in rather decrease of whiteness. In the present invention, it is preferred to express with fluorescence intensity in addition to the ISO whiteness. The fluorescence intensity is indicated by the difference between the whiteness measured with an illumination light including a light of ultraviolet region and the whiteness measured with an illumination light from which a light of ultraviolet region has been cut by a UV filter. In the present invention, the fluorescence intensity is preferably in the range of 7–15%. If it is less than 7%, the visual whiteness clearly lowers, and if it is more than 15%, the fluorescence is clearly saturated and this state cannot be said to be economically optimum.

Secondly, in the present invention, as a filler used in making the base paper, it is preferred to use calcium carbonate used in neutral papers because it can enhance the ISO whiteness. Moreover, use of calcium carbonate is preferred also from the point of increasing ink absorbability and image density as for the ink jet recording paper. Among the fillers usable in neutral base papers, calcium carbonate is high in whiteness and ink absorbability. Furthermore, it is desirable that ash content is 5–20% which is measured in accordance with JIS P-8128, except that the incineration treatment is conducted at 500° C. for 4 hours. If the ash content of the recording paper is less than 5%, ink jet recording properties are deteriorated from the points of ISO whiteness and opaqueness. If it is more than 20%, since recording papers of plain paper type are used for various uses as office papers, there are caused problems that the increase of ash content results in generation of paper powders from sides of recording paper and generation of paper powders due to the reduction of surface strength in printing.

As internal sizing agents used in making the base paper of the present invention, there may be used neutral rosin sizing agents, alkenylsuccinic anhydrides, alkyl ketene dimers, petroleum resin sizing agents, etc. which are used for neutral paper making, but as for ink jet recording papers, it is preferred to use neutral rosin sizing agents for inhibition of seep through of ink since uniform sizing effect is exhibited even in the case of low sizing. Alkenylsuccinic anhydrides and alkyl ketene dimers which are internal sizing agents generally used for neutral paper making have high sizing effect and hence can be used in a small amount, but are inferior to the neutral rosin sizing agents in imparting uniform sizing property to the whole recording paper and thus are not suitable as internal sizing agents for ink jet recording papers. Furthermore, use of neutral rosin sizing agents is preferred from the point of carrying property when the papers are used as recording papers used in electrophotographic transfer recording apparatuses.

In addition, as far as the desired effects of the present invention are not damaged, internal aids for paper making such as conventionally used various anionic, nonionic, cationic or amphoteric strengthening agents can be suitably selected and added to a stuff of paper. For example, one or two or more of various starches, polyacrylamides, polyethyleneimines, polyamines, polyamide polyamines, urea-formaldehyde resins, melamine-formaldehyde resins, vegetable gums, polyvinyl alcohols, latexes, polyethylene oxides, and polyamide resins.

Moreover, internal aids for paper making such as dyes, fluorescent brightening agents, pH adjustors, antifoamers, pitch controlling agents, and slime controlling agents can also be added depending on the purpose.

For paper making in the present invention, there may be used paper making machines known in the paper making industry, such as Fourdrinier paper machine, twin-wire paper machine, combination paper machine, cylinder paper machine and Yankee paper machine.

Thirdly, the greatest characteristic of the present invention is an ink jet recording paper comprising the above-mentioned base paper on which is coated a coating solution mainly composed of a fluorescent brightening agent, a water-soluble binder and a cationic polymer fixing agent. Strength of the surface of the base paper can be improved by coating a water-soluble binder on the base paper. Furthermore, the cationic polymer fixing agent has generally an anionic group to impart water solubility as recording papers used in ink jet recording apparatuses, and can improve fixability of ink and impart water resistance of printed images.

However, if a principal point is given to only the ink fixability of the cationic polymer fixing agent, strength of fluorescent brightening agent which is another characteristic of the present invention is reduced. As a result of intensive research conducted by the inventors on the relation between ink fixability of the cationic polymer fixing agent and reduction of strength of fluorescent brightening agent, it has been found that developability of ISO whiteness and water resistance of the ink jet printed portions are compatible when the fluorescent brightening agent is a diaminostilbene-disulfonic acid derivative (A) and the cationic polymer fixing agent is a polyvinyl alcohol-cation monomer graft polymer (B), and these are combined at a mixing ratio A:B of 1:6–2:3 in solid coating amount. Thus, the present invention has been accomplished. If the proportion of the fluorescent brightening agent is less than 1:6, the ISO whiteness decreases and if it is more than 2:3, water resistance of the ink jet printed portions is considerably deteriorated.

As the cationic polymer fixing agent in the present invention, there may be used primary to tertiary amines or monomers, oligomers or polymers of quaternary ammonium salts which form insoluble salts with sulfonic acid group, carboxyl group or amino group in water-soluble direct dyes or water-soluble acid dyes which are dye components in aqueous inks in order to give water resistance for inhibition of flowing or seeping of ink due to dropping of water on the recording paper or moisture absorption. Examples thereof are dimethylamine-epichlorohydrin condensates, acrylamide-diallylamine copolymers, polyvinylamine copolymers, dicyandiamides, dimethyl-diallylammonium chloride and polyvinyl alcohol-cation monomer graft polymers. The highest developability of the effects can be obtained when polyvinyl alcohol-cation monomer graft polymers are used.

The fluorescent brightening agents used in the present invention are required not only to absorb ultraviolet light in the daylight to supplement reflected light on the shorter wavelength side of visible region thereby to perform bluing without causing reduction of lightness, but also to be excellent in light resistance, solubility and dyeability. Examples thereof are diaminostilbene-disulfonic acid derivatives, oxazole derivatives, biphenyl derivatives, imidazole derivatives, cumarin derivatives and pyrazoline derivatives. The highest developability of the effects can be obtained for pulp fibers when diaminostilbene-disulfonic acid derivatives are used.

As water-soluble binders used here, there may be used one or more of polyvinyl alcohol, silanol-modified polyvinyl alcohol, vinyl acetate, oxidized starch, phosphoric acid esterified starch, etherified starch, cellulose derivatives such as carboxymethyl cellulose and hydroxyethyl cellulose, casein, gelatin, soybean protein, silyl-modified polyvinyl alcohol, etc.; conjugated diene copolymer latices such as maleic acid anhydride resin, styrene-butadiene copolymer and methyl methacrylate-butadiene copolymer; acrylic polymer latices such as polymers or copolymers of acrylate esters and methacrylate esters, and polymers or copolymers of acrylic acid and methacrylic acid; vinyl polymer latices such as ethylene-vinyl acetate copolymer; or functional group-modified polymer latices obtained by modifying these polymers with monomers containing functional group such as carboxyl group; aqueous adhesives such as thermosetting synthetic resins, e.g., melamine resin and urea resin; and synthetic resin adhesives such as polymethyl methacrylate, polyurethane resin, unsaturated polyester resin, vinyl chloride-vinyl acetate copolymer, polyvinyl butyral and alkyd resin. In addition, known natural and synthetic resin adhesives may be used without any limitation.

In the present invention, at least one of a coloring dye and a coloring pigment can be added in combination with the fluorescent brightening agent to the coating solution. The coloring dye and the coloring pigment can be used each alone or in admixture. For the purpose of the present invention, preferably a bluing agent absorbing a yellow light of 580–600 nm in wavelength is used. The coloring dye and the coloring pigment may be any of those which are generally used, but more preferred are dioxazine pigments and phthalocyanine pigments which are anionic coloring pigments from the points of compatibility with the water-soluble binder, light resistance and uniform color formation at the time of coating.

Furthermore, there may be suitably added other additives such as surface sizing agent, pH adjustor, thickening agent, fluidity improving agent, anti-foaming agent, foam-inhibitor, releasing agent, foaming agent, penetrating agent, coloring dye, coloring pigment, fluorescent brightening agent, ultraviolet absorber, preservative, mildew-proofing agent, antioxidant, inorganic conducting agent such as sodium chloride or calcium chloride, and organic conducting agent.

For coating the coating solution mainly composed of the fluorescent brightening agent, the water-soluble binder and the cationic polymer fixing agent by size press, there may be employed conventional size press, gate roll size press, film transfer type size press, rod coater, bill blade, short dowel coater, etc. Of these coating apparatuses, preferred are those types which can uniformly coat the fluorescent brightening agent on the paper layer in on-machine manner, and on-machine size press apparatus is preferred. After coating, if necessary, the coat may be finished using calendering apparatuses such as machine calender, hot calender, super calender and soft calender.

The coating amount is not especially limited. The coating amount depends on the sizing property of the base paper, but is desirably about 1–3 $g/m^2$ in solid content of the coating solution.

Wood pulps used for making the base paper of the present invention include, for example, NBKP, LBKP, NBSP, LBSP, GP, TMP and, besides, waste paper pulp. Several of these pulps may be used in admixture at a ratio depending on the purpose.

As the constituent materials for the waste paper pulp used in the present invention, mention may be made of white shaving paper (johaku), ruled white paper (keihaku), creamy white paper (cream johaku), card, special white paper (tokuhaku), medium white paper (chuhaku), flyleaf shaving paper (mozou), fair paper (irojo), Kent paper, white art paper (shiro art), finest cut paper (tokujogiri), special cut paper (betsujogiri), newspaper, magazine paper, etc. which are shown in the standard table for waste paper standard quality supplied by the Waste Paper Regeneration Acceleration Center Foundation. Typical examples are OA waste papers such as non-coated papers for computers which are information-related papers, papers for printers, e.g., heat-sensitive papers and pressure-sensitive papers, and PPC recording papers, and waste papers of papers or boards, e.g., coated papers such as art papers, coated papers, slightly coated papers (bitoko papers), and matte papers, and non-coated papers such as woodfree papers, color woodfree papers, notebook papers, letter papers, packing papers, fancy papers, woodcontain papers, newspapers, groundwood papers, supercalendered papers, flyleaf shaving papers, pure white machine glazed papers, and milk cartons, and these waste papers are chemical pulp papers and high yield pulp-containing papers. These are not limited irrespective of printed papers, copied papers, or non-printed papers.

The ink jet recording papers of the present invention can be used as office papers such as electro-photographic transfer papers, heat transfer image receiving papers and printing papers in addition to ink jet recording papers.

The present invention will be explained in detail by the following examples, which do not limit the invention. All "part" and "%" below are by weight.

EXAMPLES 1–10 AND COMPARATIVE EXAMPLES 1–8

First, base papers 1–6 were made in accordance with the following formulation.

| | Part |
|---|---|
| <Base paper formulation 1> | |
| Pulp; LBKP (Freeness; 450 ml, c.s.f) | 100 |
| Calcium carbonate (TP-121 manufactured by Okutama Kogyo Co., Ltd.) | 20 |
| Neutral rosin sizing agent (CC-167 manufactured by Japan PMC Co., Ltd.) | 0.4 |
| Aluminum sulfate | 1.4 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |
| <Base paper formulation 2> | |
| Pulp; LBKP (Freeness; 450 ml, c.s.f) | 100 |
| Calcium carbonate (TP-121 manufactured by Okutama Kogyo Co., Ltd.) | 10 |
| Neutral rosin sizing agent (CC-167 manufactured by Japan PMC Co., Ltd.) | 0.4 |
| Aluminum sulfate | 1.4 |
| Fluorescent brightening agent (Keikol BUL manufactured by Nippon Soda Co., Ltd.) | 0.02 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |
| <Base paper formulation 3> | |
| Pulp; Highly white LBKP for photographic base paper(Freeness; 450 ml, c.s.f) | 100 |
| Talc (B Talc manufactured Kami Talc Co., Ltd. | 6 |
| Rosin sizing agent (Hasize L-750 manufactured by Harima Kasei Co., Ltd.) | 0.3 |
| Aluminum sulfate | 1.5 |
| Fluorescent brightening agent (Keikol BUL manufactured by Nippon Soda Co., Ltd.) | 0.02 |
| Cation starch (Cato 304 manufactured by Japan NSC Co., Ltd.) | 0.3 |
| Dye (Basazole Violet 57L manufactured by BASF) | 0.00096 |
| Yield improving agent (Highholder 301 manufactured by Kurita Kogyo Co. Ltd.) | 0.03 |
| <Base paper formulation 4> | |
| Pulp; Highly white LBKP for photographic base paper(Freeness; 450 ml, c.s.f) | 100 |
| Talc (B Talc manufactured Kami Talc Co., Ltd. | 10 |
| Rosin sizing agent (Hasize L-750 manufactured by Harima Kasei Co., Ltd.) | 0.3 |
| Aluminum sulfate | 1.5 |
| Fluorescent brightening agent (Keikol BUL manufactured by Nippon Soda Co., Ltd.) | 0.02 |
| Cation starch (Cato 304 manufactured by Japan NSC Co., Ltd.) | 0.3 |
| Dye (Basazole Violet 57L manufactured by BASF) | 0.00096 |
| Yield improving agent (Highholder 301 manufactured by Kurita Kogyo Co. Ltd.) | 0.03 |

-continued

| | Part |
|---|---|
| <Base paper formulation 5> | |
| Pulp; Highly white LBKP for photographic base paper(Freeness; 450 ml, c.s.f) | 100 |
| Talc (B Talc manufactured Kami Talc Co., Ltd. | 15 |
| Rosin sizing agent (Hasize L-750 manufactured by Harima Kasei Co., Ltd.) | 0.3 |
| Aluminum sulfate | 1.5 |
| Fluorescent brightening agent (Keikol BUL manufactured by Nippon Soda Co., Ltd.) | 0.02 |
| Cation starch (Cato 304 manufactured by Japan NSC Co., Ltd.) | 0.3 |
| Dye (Basazole Violet 57L manufactured by BASF) | 0.00096 |
| Yield improving agent (Highholder 301 manufactured by Kurita Kogyo Co. Ltd.) | 0.03 |
| <Base paper formulation 6> | |
| Pulp; LBKP (Freeness; 450 ml, c.s.f) | 100 |
| Calcium carbonate (TP-121 manufactured by Okutama Kogyo Co., Ltd.) | 20 |
| Neutral rosin sizing agent (CC-167 manufactured by Japan PMC Co., Ltd.) | 0.4 |
| Aluminum sulfate | 1.4 |
| Fluorescent brightening agent (Keikol BUL manufactured by Nippon Soda Co., Ltd.) | 1.0 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |
| <Base paper formulation 7> | |
| Pulp; LBKP (Freeness; 450 ml, c.s.f) | 80 |
| Pulp; DIP (Freeness; 400 ml, c.s.f) | 20 |
| Calcium carbonate (TP-121 manufactured by Okutama Kogyo Co., Ltd.) | 10 |
| Neutral rosin sizing agent (CC-167 manufactured by Japan PMC Co., Ltd.) | 0.4 |
| Aluminum sulfate | 1.4 |
| Fluorescent brightening agent (Keikol BUL manufactured by Nippon Soda Co., Ltd.) | 0.02 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |

Using 0.3% slurries of the above formulations, base papers of 78.4 g/m$^2$ in basis weight and 5.0% in water content were made at a paper making width of 1,300 mm and a paper making speed of 150 m/min by a Fourdrinier paper machine, and these were used as base papers for size press.

Ink jet recording papers of examples and comparative examples were prepared by the following methods.

Example 1

Base paper 2 made above was subjected to size press with the size press solution of the following formulation to obtain an ink jet recording paper of 3.0 g/m$^2$ in solid coating amount, which was an ink jet recording paper of Example 1. Ash content of the base paper 2 was 8.9%.

<Formulation of size press solution 1>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (Keikol BRAL manufactured by Nippon Soda Co., Ltd.) | 0.5 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 93.393 |

Example 2

An ink jet recording paper of Example 2 was prepared in the same manner as in Example 1, except that the following size press solution 2 was used in place of the size press solution 1.

<Formulation of size press solution 2>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (Keikol BRAL manufactured by Nippon Soda Co., Ltd.) | 1.0 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 92.893 |

Example 3

An ink jet recording paper of Example 3 was prepared in the same manner as in Example 1, except that the following size press solution 3 was used in place of the size press solution 1.

<Formulation of size press solution 3>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (Keikol BRAL manufactured by Nippon Soda Co., Ltd.) | 1.5 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |

-continued

<Formulation of size press solution 3>

| | Part |
|---|---|
| Coloring pigment (TB1548 Violet manufactured by Dainichiseika Kogyo Co., Ltd.) | 0.003 |
| Water | 92.393 |

Example 4

An ink jet recording paper of Example 4 was prepared in the same manner as in Example 1, except that the following size press solution 4 was used in place of the size press solution 1.

<Formulation of size press solution 4>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (Keikol BRAL manufactured by Nippon Soda Co., Ltd.) | 2.0 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 91.893 |

Example 5

An ink jet recording paper of Example 5 was prepared in the same manner as in Example 1, except that base paper 1 was used in place of the base paper 2. The ash content of the base paper 1 was 17.3%.

Example 6

An ink jet recording paper of Example 6 was prepared in the same manner as in Example 1, except that the following size press solution 5 was used in place of the size press solution 1.

<Formulation of size press solution 5>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 0.75 |
| Fluorescent brightening agent (Keikol BRAL manufactured by Nippon Soda Co., Ltd.) | 0.25 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 95.893 |

Example 7

An ink jet recording paper of Example 7 was prepared in the same manner as in Example 4, except that base paper 6 was used in place of the base paper 2. The ash content of the base paper 6 was 17.5%.

Example 8

An ink jet recording paper of Example 8 was prepared in the same manner as in Example 1, except that base paper 7 was used in place of the base paper 2. The ash content of the base paper 7 was 9.3%.

Example 9

An ink jet recording paper of Example 9 was prepared in the same manner as in Example 1, except that the following size press solution 6 was used in place of the size press solution 1.

<Formulation of size press solution 6>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (Keikol BRAL manufactured by Nippon Soda Co., Ltd.) | 0.5 |
| Cationic surface sizing agent (Basoplast 265D manufactured by BASF) | 0.1 |
| Dye (Sumilight Supra Blue manufactured by Sumitomo Chemical Co., Ltd.) | 0.002 |
| Dye (Sumilight Supra Violet manufactured by Sumitomo Chemical Co., Ltd.) | 0.003 |
| Water | 93.395 |

Example 10

An ink jet recording paper of Example 10 was prepared in the same manner as in Example 5, except that the following size press solution 7 was used in place of the size press solution 1.

<Formulation of size press solution 7>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (Keikol BRAL manufactured by Nippon Soda Co., Ltd.) | 0.5 |
| Cationic surface sizing agent (Basoplast 265D manufactured by BASF) | 0.1 |
| Water | 93.4 |

Example 11

An ink jet recording paper of Example 11 was prepared in the same manner as in Example 1, except that the following size press solution 8 was used in place of the size press solution 1.

<Formulation of size press solution 8>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (commercially available triazole derivative) | 1.0 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 92.893 |

Comparative Example 1

The base paper 3 made above was subjected to size press with the size press solution 1 to obtain an ink jet recording paper of 3.0 g/m$^2$ in solid coating amount. This was referred to as ink jet recording paper 1 of Comparative Example 1. The ash content of the base paper 3 was 5.9%.

Comparative Example 2

An ink jet recording paper of Comparative Example 2 was prepared in the same manner as in Comparative Example 1, except that the base paper 4 was used in place of the base paper 3. The ash content of the base paper 4 was 9.3%.

Comparative Example 3

An ink jet recording paper of Comparative Example 3 was prepared in the same manner as in Comparative Example 1, except that the base paper 5 was used in place of the base paper 3. The ash content of the base paper 5 was 13.0%.

Comparative Example 4

An ink jet recording paper of Comparative Example 4 was prepared in the same manner as in Example 1, except that the following size press solution 8 was used in place of the size press solution 1.

<Formulation of size press solution 8>

| | Part |
|---|---|
| Oxidized starch (MS3800 manufactured by Nippon Shokuhin Kako Co., Ltd.) | 3.5 |
| Cationic polymer fixing agent (SC-600G2 manufactured by Hymo Co., Ltd.) | 3 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 93.393 |

Comparative Example 5

An ink jet recording paper of Comparative Example 5 was prepared in the same manner as in Comparative Example 4, except that the base paper 1 was used in place of the base paper 2.

Comparative Example 6

The base paper 2 made above was subjected to size press with the following size press solution 9 to obtain an ink jet recording paper of 3.0 g/m$^2$ in solid coating amount. This was an ink jet recording paper of Comparative Example 6.

<Formulation of size press solution 9>

| | Part |
|---|---|
| Oxidized starch (MS3800 manufactured by Nippon Shokuhin Kako Co., Ltd.) | 6 |
| Fluorescent brightening agent (Keikol BRAL manufactured by Nippon Soda Co., Ltd.) | 0.5 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 93.393 |

Comparative Example 7

"Bright White" of Hewlett-Packard Co., Ltd. commercially available in U.S.A. was bought and employed as a sample of Comparative Example 7.

Comparative Example 8

"PB Paper", an electrophotographic and ink jet-common paper of Canon, Inc. commercially available in Japan was bought and employed as a sample of Comparative Example 8.

ISO whiteness and fluorescence intensity of the recording papers of Examples 1–11 and Comparative Examples 1–8 were measured by the following methods. The results are shown in Table 1.

(1) ISO Whiteness:

The sample a subjected to moisture conditioning in an environment of 20° C., 65% RH for 24 hours and, then, ISO whiteness was measured in accordance with JIS P-8148 using PF-10 manufactured by Nippon Denshoku Kogyo Co., Ltd. in which a xenon flash lamp was used as a light source. The measurement was conducted using ten test pieces, and the average value of whiteness of the upper surface and that of the under surface of the test piece was employed as the ISO whiteness. In full color printing, when remarkable whiteness is required, the ISO whiteness is preferably not less than 95%.

(2) Fluorescence Intensity:

The sample was subjected to moisture conditioning in an environment of 20° C., 65% RH for 24 hours and, then, ISO whiteness was measured in accordance with JIS P-8148 using PF-10 manufactured by Nippon Denshoku Kogyo Co., Ltd. in which a xenon flash lamp was used as a light source, with or without using a UV cut filter. The fluorescence intensity was expressed as a difference between ISO whiteness in the case of using no UV cut filter and ISO whiteness in the case of using the UV cut filter. The measurement was conducted using ten test pieces, and the average value of the upper surface and the under surface of the test piece was employed as fluorescence intensity. For the papers used in every-day life, the fluorescence intensity is preferably 7–15%.

The ink jet properties were evaluated by the following methods, and the results are shown in Table 1.

(1) Water Resistance of Image:

Letters and ruled lines were printed by an ink jet printer BJ-420J manufactured by Canon, Inc. One drop of distilled water was dropped on the printed portion by a No.15 injection needle, followed by drying with leaving, and degree of blotting of the ink was visually evaluated. Criteria for evaluation were as follows. A: Good, B: Good with no practical problems, C: There were practical problems, and D: Bad.

(2) Print Density:

A black solid pattern was printed by an ink jet printer BJ-420J manufactured by Canon, Inc. The print was dried by leaving, and, then, optical density was measured by Macbeth densitometer. As for evaluation standard, a density of not less than 1.2 is practically preferred.

(3) Image Reproducibility:

N1 and N4 images of highly minute digital standard image data in accordance with JIS X-9201 published from Japanese Standards Association were printed by an ink jet printer BJ-420J manufactured by Canon, Inc. After the print was dried by leaving, the difference in hue value between the printed sample and the attached print sample was evaluated. For N1, change in flesh color of the highlight part in the face and the palm of the hand of the woman and balance of color in the grayish background were evaluated, and for N4, tone of light part in the metal tableware and glass and reproducibility of neutral color were mainly evaluated. Criteria for evaluation were as follows. A: Good, B: Good with no practical problems, C: There were practical problems, and D: Bad.

TABLE 1

| | ISO whiteness (%) | Fluorescence intensity (%) | Image density | Water resistance | Image reproducibility |
|---|---|---|---|---|---|
| Example 1 | 98.8 | 8.1 | 1.35 | A | A |
| Example 2 | 100.6 | 9.4 | 1.35 | A | A |
| Example 3 | 101.0 | 9.9 | 1.35 | A | A |
| Example 4 | 101.2 | 10.2 | 1.34 | A | A |
| Example 5 | 100.3 | 9.2 | 1.38 | A | A |
| Example 6 | 95.2 | 7.3 | 1.32 | B | B |
| Example 7 | 102.5 | 14.8 | 1.33 | A | A |
| Example 8 | 96.5 | 8.3 | 1.30 | A | B |
| Example 9 | 98.2 | 8.2 | 1.34 | A | A |

TABLE 1-continued

| | ISO whiteness (%) | Fluorescence intensity (%) | Image density | Water resistance | Image reproducibility |
|---|---|---|---|---|---|
| Example 10 | 97.0 | 9.7 | 1.37 | A | B |
| Example 11 | 95.2 | 7.5 | 1.24 | B | A |
| Comparative Example 1 | 93.6 | 7.5 | 1.25 | A | C |
| Comparative Example 2 | 94.1 | 7.4 | 1.25 | A | C |
| Comparative Example 3 | 92.8 | 7.5 | 1.28 | A | C |
| Comparative Example 4 | 90.3 | 2.8 | 1.24 | A | D |
| Comparative Example 5 | 92.5 | 0.3 | 1.30 | A | D |
| Comparative Example 6 | 98.6 | 9.0 | 1.25 | D | A |
| Comparative Example 7 | 107.0 | 13.0 | 1.15 | D | A |
| Comparative Example 8 | 84.5 | 0.2 | 1.33 | D | C |

According to the results of evaluation, it can be seen that as is clear from the results of Examples 1–6, an ISO whiteness of not less than 95% and a fluorescence intensity of not less than 7% are necessary for obtaining good image density and image reproducibility. Furthermore, it can be seen from Example 7 that even when the fluorescence intensity is increased to nearly 15%, the image density and the image reproducibility become saturated. From Example 9, it can be seen that not only a pigment, but also a dye can be used as the coloring agent in the size press formulation; from Example 10, it can be seen that there are caused no problems even when dye or pigment is not used in the size press solution; and from Example 11, it can be seen that various fluorescent brightening agents can be used. As is clear from Comparative Examples 1–5, when one of the ISO whiteness and the fluorescence intensity does not meet the requirements, the image reproducibility is deteriorated. Moreover, as is shown in Comparative Example 6, if a cationic fixing agent is not coated, water resistance is considerably deteriorated.

Examples 12–16

For the purpose of clarification of the characteristics of the second invention provided by combination, base papers 8–12 were made in accordance with the following formulations.

| | Part |
|---|---|
| <Base paper formulation 8> | |
| Pulp; LBKP (Freeness; 450 ml, c.s.f) | 100 |
| Calcium carbonate (TP-121 manufactured by Okutama Kogyo Co., Ltd.) | 26 |
| Neutral rosin sizing agent (CC-167 manufactured by Japan PMC Co., Ltd.) | 0.4 |
| Aluminum sulfate | 1.4 |
| Amphoteric starch (Cato 3210 manufactured by Japan NSC Co., Ltd.) | 1 |
| Dye (Basazole Violet 57 manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |
| <Base paper formulation 9> | |
| Pulp; LBKP (Freeness; 450 ml, c.s.f) | 100 |
| Calcium carbonate (TP-121 manufactured by Okutama Kogyo Co., Ltd.) | 32 |
| Neutral rosin sizing agent (CC-167 manufactured by Japan PMC Co., Ltd.) | 0.4 |
| Aluminum sulfate | 1.4 |

-continued

| | Part |
|---|---|
| Fluorescent brightening agent (Keikol BUL manufactured by Nippon Soda Co., Ltd.) | 0.02 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.030 |
| Yield improving agent (Organozob O manufactured by Allied Colloid Co. Ltd.) | 0.15 |
| <Base paper formulation 10> | |
| Pulp; LBKP (Freeness; 450 ml, c.s.f) | 100 |
| Calcium carbonate (TP-121 manufactured by Okutama Kogyo Co., Ltd.) | 21 |
| Neutral rosin sizing agent (CC-167 manufactured by Japan PMC Co., Ltd.) | 0.4 |
| Aluminum sulfate | 1.4 |
| Amphoteric starch (Cato 3210 manufactured by Japan NSC Co., Ltd.) | 1.0 |
| Dye (Basazole Violet 57 manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |
| <Base paper formulation 11> | |
| Pulp; LBKP (Freeness; 450 ml, c.s.f) | 100 |
| Calcium carbonate (TP-121 manufactured by Okutama Kogyo Co., Ltd.) | 11 |
| Neutral rosin sizing agent (CC-167 manufactured by Japan PMC Co., Ltd.) | 0.4 |
| Aluminum sulfate | 1.4 |
| Fluorescent brightening agent (Keikol BUL manufactured by Nippon Soda Co., Ltd.) | 0.02 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |
| <Base paper formulation 12> | |
| Pulp; LBKP (Freeness; 450 ml, c.s.f) | 100 |
| Calcium carbonate (TP-121 manufactured by Okutama Kogyo Co., Ltd.) | 6 |
| Neutral rosin sizing agent (CC-167 manufactured by Japan PMC Co., Ltd.) | 0.4 |
| Aluminum sulfate | 1.4 |
| Fluorescent brightening agent (Keikol BUL manufactured by Nippon Soda Co., Ltd.) | 0.02 |
| Amphoteric starch (Cato 3210 manufactured by Japan NSC Co., Ltd.) | 1.0 |

-continued

| | Part |
|---|---|
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |

Using 0.3% slurries of the above formulations, base papers of 78.4 g/m$^2$ in basis weight and 5.0% in water content were made at a paper making width of 1,300 mm and a paper making speed of 150 m/min by a Fourdrinier paper machine, and these were used as base papers for size press.

Ink jet recording papers of examples were prepared by the following methods.

Example 12

Base paper 11 made above was subjected to size press with the size press solution 1 to obtain an ink jet recording paper of 3.0 g/m$^2$ in solid coating amount, which was an ink jet recording paper of Example 12. The ash content of the base paper 11 was 8.9%.

Example 13

An ink jet recording paper of Example 13 was prepared in the same manner as in Example 12, except that base paper 10 was used in place of the base paper 11. The ash content of the base paper 10 was 17.2%.

Example 14

An ink jet recording paper of Example 14 was prepared in the same manner as in Example 12, except that base paper 8 was used in place of the base paper 11. The ash content of the base paper 8 was 19.7%.

Example 15

An ink jet recording paper of Example 15 was prepared in the same manner as in Example 12, except that base paper 12 was used in place of the base paper 11. The ash content of the base paper 12 was 4.8%.

Example 16

An ink jet recording paper of Example 16 was prepared in the same manner as in Example 12, except that base paper 9 was used in place of the base paper 11. The ash content of the base paper 9 was 22.3%.

ISO whiteness, fluorescence intensity and ink jetting properties of the recording papers of Examples 12–16 were measured by the above-mentioned methods. Surface strength was measured by the following method.

The results are shown in Table 2.

(1) Surface Strength:

The sample was subjected to moisture conditioning in an environment of 20%, 65% RH for 24 hours and, then, a commercially available cellophane adhesive tape of 18 mm in width (Cello Tape manufactured by Nichiban Co., Ltd.) was applied to the sample at a linear pressure of 300 g/cm, followed by peeling the tape at a rate of 1 cm/sec. The surface strength was judged by the amount of powders adhered to the tape. Criteria for evaluation were as follows. A: Substantially no powders adhered to the tape and the surface strength was high; B: Powders slightly adhered to the tape, but there were no practical problems; C: Powders adhered to the tape and there were caused problems depending on use conditions; D: Considerable powders adhered to the tape and there were practical problems; and E: A large amount of powders adhered to the tape and the sample could not be used.

TABLE 2

| | Ash content (%) | Image density | Water resistance | Image reproducibility | Surface strength |
|---|---|---|---|---|---|
| Example 12 | 8.9 | 1.35 | A | A | A |
| Example 13 | 17.2 | 1.31 | A | A | A |
| Example 14 | 19.7 | 1.30 | A | A | B |
| Example 15 | 4.8 | 1.23 | B | B | A |
| Example 16 | 22.3 | 1.30 | A | A | C |

Considering the above results, it is clear from Examples 12–14 that ink jet recording papers high in image density and excellent in not only water resistance and image reproducibility, but also in surface strength can be obtained by combining the feature that a coating solution containing a fluorescent brightening agent, a water-soluble binder and a cationic polymer fixing agent as main components is coated on a base paper of 5–20% in ash content of calcium carbonate as a filler with the feature that the coated paper has an ISO whiteness of not less than 95% and a fluorescence intensity of 7–15% measured by a method specified in JIS P-8148 using a xenon flash lamp as a light source. If the ash content of calcium carbonate exceeds 20% as in Example 16, water resistance, image density and image reproducibility are improved, but surface strength is greatly deteriorated. Moreover, if the ash content of calcium carbonate is less than 5% as in Example 15, water resistance, image density and image reproducibility are deteriorated, though the surface strength is maintained.

Examples 17–22 and Comparative Examples 9–10

For the purpose of clarification of the characteristics of the third invention provided by combination, base papers 13–14 were made in accordance with the following formulations.

| | Part |
|---|---|
| <Base paper formulation 13> | |
| Pulp; LBKP (Freeness; 450 ml, c.s.f) | 100 |
| Calcium carbonate (TP-121 manufactured by Okutama Kogyo Co., Ltd.) | 12 |
| Neutral rosin sizing agent (CC-167 manufactured by Japan PMC Co., Ltd.) | 0.4 |
| Aluminum sulfate | 1.4 |
| Fluorescent brightening agent (Keikol BUL manufactured by Nippon Soda Co., Ltd.) | 0.02 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |

-continued

| | Part |
|---|---|
| <Base paper formulation 14> | |
| Pulp; LBKP (Freeness; 450 ml, c.s.f) | 80 |
| Pulp; DIP (Freeness; 400 ml, c.s.f) | 20 |
| Calcium carbonate (TP-121 manufactured by Okutama Kogyo Co., Ltd.) | 12 |
| Neutral rosin sizing agent (CC-167 manufactured by Japan PMC Co., Ltd.) | 0.4 |
| Aluminum sulfate | 1.4 |
| Fluorescent brightening agent (Keikol BUL manufactured by Nippon Soda Co., Ltd.) | 0.02 |
| Amphoteric starch (Cato 3210 manufactured by Japan NSC Co., Ltd.) | 1.0 |
| Dye (Basazole Violet 57L manufactured by BASF) | 0.00096 |
| Yield improving agent (Parcol 57 manufactured by Allied Colloid Co. Ltd.) | 0.025 |
| Yield improving agent (Organozob O manufactured by Allied Colloid Co. Ltd.) | 0.1 |

Using 0.3% slurries of the above formulations, base papers of 78.4 g/m$^2$ in basis weight and 5.0% in water content were made at a paper making width of 1,300 mm and a paper making speed of 150 m/min by a Fourdrinier paper machine, and these were used as base papers for size press.

Ink jet recording papers of examples and comparative examples were prepared by the following methods.

Example 17

Base paper 13 made above was subjected to size press with the size press solution 1 to obtain an ink jet recording paper of 3.0 g/m$^2$ in solid coating amount, which was an ink jet recording paper of Example 17. The ash content of the base paper 13 was 10.7%.

Example 18

An ink jet recording paper of Example 18 was prepared in the same manner as in Example 13, except that the size press solution 2 was used in place of the size press solution 1.

Example 19

An ink jet recording paper of Example 19 was prepared in the same manner as in Example 17, except that the size press solution 3 was used in place of the size press solution 1.

Example 20

An ink jet recording paper of Example 20 was prepared in the same manner as in Example 17, except that the size press solution 4 was used in place of the size press solution 1.

Example 21

Base paper 14 made above was subjected to size press with the size press solution 1 to obtain an ink jet recording paper of 3.0 g/m$^2$ in solid coating amount, which was an ink jet recording paper of Example 21. The ash content of the base paper 14 in this case was 10.9%.

Example 22

An ink jet recording paper of Example 22 was prepared in the same manner as in Example 17, except that the following size press solution 10 was used in place of the size press solution 1.

<Formulation of size press solution 10>

| | Part |
|---|---|
| Oxidized starch (MS3800 manufactured by Nippon Shokuhin Kako Co., Ltd.) | 5 |
| Cationic polymer fixing agent (SC-600G2 manufactured by Hymo Co., Ltd.) | 0.71 |
| Fluorescent brightening agent (Keikol BRAL manufactured by Nippon Soda Co., Ltd.) | 0.5 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 93.683 |

Example 23

An ink jet recording paper of Example 23 was prepared in the same manner as in Example 17, except that the following size press solution 11 was used which contained an acrylamide-diallylamine copolymer as the cationic polymer fixing agent in the size press solution 1.

<Formulation of size press solution 11>

| | Part |
|---|---|
| Oxidized starch (MS3800 manufactured by Nippon Shokuhin Kako Co., Ltd.) | 3 |
| Cationic polymer fixing agent (commercially available acrylamide-diallylamine copolymer) | 3 |
| Fluorescent brightening agent (Keikol BRAL manufactured by Nippon Soda Co., Ltd.) | 0.5 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 93.393 |

Example 24

An ink jet recording paper of Example 24 was prepared in the same manner as in Example 17, except that the following size press solution 12 was used which contained a dimethylamine-epichlorohydrin polycondensate as the cationic polymer fixing agent in the size press solution 1.

<Formulation of size press solution 12>

| | Part |
|---|---|
| Oxidized starch (MS3800 manufactured by Nippon Shokuhin Kako Co., Ltd.) | 3 |

-continued

<Formulation of size press solution 12>

| | Part |
|---|---|
| Cationic polymer fixing agent (commercially available dimethylamine-epichlorohydrin polycondensate) | 3 |
| Fluorescent brightening agent (Keikol BRAL manufactured by Nippon Soda Co., Ltd.) | 0.5 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 93.393 |

Example 25

An ink jet recording paper of Example 25 was prepared in the same manner as in Example 17, except that the following size press solution 13 was used which contained a triazole derivative as the fluorescent brightening agent in the size press solution 1.

<Formulation of size press solution 13>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (commercially available triazole derivative) | 1.5 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 92.493 |

Example 26

An ink jet recording paper of Example 26 was prepared in the same manner as in Example 17, except that the following size press solution 14 was used which contained an imidazole derivative as the fluorescent brightening agent in the size press solution 1.

<Formulation of size press solution 14>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (commercially available imidazole derivative) | 1.0 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |

-continued

<Formulation of size press solution 14>

| | Part |
|---|---|
| Coloring pigment (TB1548 Violet manufactured by Dainichiseika Kogyo Co., Ltd.) | 0.003 |
| Water | 92.893 |

Comparative Example 9

An ink jet recording paper of Comparative Example 9 was prepared in the same manner as in Example 17, except that the following size press solution 15 was used in place of the size press solution 1.

<Formulation of size press solution 15>

| | Part |
|---|---|
| Oxidized starch (MS3800 manufactured by Nippon Shokuhin Kako Co., Ltd.) | 3 |
| Cationic polymer fixing agent (SC-600G2 manufactured by Hymo Co., Ltd.) | 3 |
| Fluorescent brightening agent (Keikol BRAL manufactured by Nippon Soda Co., Ltd.) | 0.4 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 93.493 |

Comparative Example 10

An ink jet recording paper of Comparative Example 10 was prepared in the same manner as in Example 17, except that the following size press solution 16 was used in place of the size press solution 1.

<Formulation of size press solution 16>

| | Part |
|---|---|
| Cationic polymer fixing agent (SC-600G2 manufactured by Hymo Co., Ltd.) | 6 |
| Fluorescent brightening agent (Keikol BRAL manufactured by Nippon Soda Co., Ltd.) | 0.9 |
| Cationic surface sizing agent (Basoplast 265D manufactured by BASF) | 0.1 |
| Coloring pigment (TB536 Blue manufactured by Dainichiseika Kogyo Co., Ltd.) | 0.004 |
| Coloring pigment (TB1548 Violet manufactured by Dainichiseika Kogyo Co., Ltd.) | 0.003 |
| Water | 92.993 |

ISO whiteness and fluorescence intensity of the recording papers of Examples 17–26 and Comparative Examples 9–10 were measured by the above-mentioned methods. The results are shown in Table 3.

Furthermore, image reproducibility and surface strength which were ink jet properties were measured by the above-mentioned methods. Moreover, water resistance of image and print density were measured by the following methods.

The results are shown in Table 4.

(1) Water Resistance of Image:

Letters and ruled lines were printed by an ink jet printer BJ-420J manufactured by Canon, Inc. One drop of distilled water was dropped on the printed black and magenta portions by a No.15 injection needle, followed by drying with leaving, and degree of blotting of the ink was visually evaluated. Criteria for evaluation were as follows. A: Good, B: Good with no practical problems, C: There were practical problems, and D: Bad.

(2) Print Density:

Solid patterns of four full colors were printed by an ink jet printer BJ-420J manufactured by Canon, Inc. The print was dried by leaving, and, then, optical densities of black and magenta were measured by Macbeth densitometer. As for evaluation standard, a density of not less than 1.2 is practically preferred.

TABLE 3

| | Fluorescent brightening agent | | Cationic polymer fixing agent | | ISO whiteness | Fluorescence intensity |
|---|---|---|---|---|---|---|
| | Kind | Amount | Kind | Amount | (%) | (%) |
| Example 17 | ① | 0.5 | ① | 3.0 | 99.0 | 8.1 |
| Example 18 | ① | 1.0 | ① | 3.0 | 100.8 | 9.5 |
| Example 19 | ① | 1.5 | ① | 3.0 | 101.3 | 9.9 |
| Example 20 | ① | 2.0 | ① | 3.0 | 101.5 | 10.3 |
| Example 21 | ① | 1.0 | ① | 3.0 | 98.8 | 9.6 |
| Example 22 | ① | 0.5 | ① | 0.71 | 99.4 | 8.7 |
| Example 23 | ① | 1.0 | ② | 3.0 | 101.1 | 9.8 |
| Example 24 | ① | 1.0 | ③ | 3.0 | 100.5 | 9.3 |
| Example 25 | ② | 1.0 | ① | 3.0 | 95.8 | 7.7 |
| Example 26 | ③ | 1.0 | ① | 3.0 | 95.1 | 7.4 |
| Comparative Example 9 | ① | 0.4 | ① | 3.0 | 93.9 | 5.6 |
| Comparative Example 10 | ① | 0.9 | ① | 6.0 | 94.6 | 6.8 |

Fluorescent brightening agent: ① Diaminostilbene-disulfonic acid derivative. ② Triazole derivative. ③ Imidazole derivative.

Cationic polymer fixing agent:

① Polyvinyl alcohol-cation monomer graft polymer.

② Acrylamide-diallylamine copolymer.

③ Dimethylamine-epichlorohydrin polycondensate.

TABLE 4

| | Image density | | Water resistance of image | | Image | |
|---|---|---|---|---|---|---|
| | BLACK | MAGENTA | BLACK | MAGENTA | reproducibility | Surface strength |
| Example 17 | 1.35 | 1.20 | A | A | A | A |
| Example 18 | 1.35 | 1.21 | A | A | A | A |
| Example 19 | 1.35 | 1.21 | A | A | A | A |
| Example 20 | 1.34 | 1.20 | A | B | A | A |
| Example 21 | 1.30 | 1.20 | A | A | A | A |
| Example 22 | 1.30 | 1.19 | C | C | B | A |
| Example 23 | 1.25 | 1.20 | B | C | A | A |
| Example 24 | 1.28 | 1.21 | B | C | A | A |
| Example 25 | 1.27 | 1.19 | A | B | B | A |
| Example 26 | 1.25 | 1.18 | A | B | B | A |
| Comparative Example 9 | 1.28 | 1.17 | C | D | C | A |
| Comparative Example 10 | 1.34 | 1.20 | A | A | C | D |

As is clear from Examples 17–20, ISO whiteness and fluorescence intensity are high and image density and water resistance of ink jet properties are excellent when the fluorescent brightening agent is a diaminostilbene-disulfonic acid derivative (A) and the cationic polymer fixing agent is a polyvinyl alcoholcation monomer graft polymer (B), and mixing ratio A:B in solid coating amount is in the range of 1:6–2:3. However, as is seen in Comparative Example 9, when concentration of the fluorescent brightening agent is lower than the above range, not only the ISO whiteness, but also the fluorescence intensity are considerably deteriorated. As is seen in Comparative Example 10, the similar phenomenon also occurs when the concentration is high because the fluorescent brightening agent is deactivated due to the cation group of the fixing agent. In Example 22, concentration of the cationic polymer fixing agent is lower than the above range, and, in this case, water resistance begins to be deteriorated. In Examples 23 and 24 where the kind of the fluorescent brightening agent is changed, the balance between the image density and water resistance is somewhat broken. In Examples 25 and 26 where the kind of the cationic polymer fixing agent is changed, the ISO whiteness and the fluorescence intensity tend to decrease and the image density also begins to deteriorate. These results clearly show that ink jet recording papers which are most preferred in ISO whiteness, fluorescence intensity and ink jet properties can be obtained when the fluorescent brightening agent is a diaminostilbene-disulfonic acid derivative and the cationic polymer fixing agent is a polyvinyl alcohol-cation monomer graft polymer, and the mixing ratio A:B in solid coating amount is in the range of 1:6–2:3.

INDUSTRIAL APPLICABILITY

The ink let recording paper of the present invention is an ink jet recording paper of plain paper type, characterized in that it comprises a neutral base paper comprising a wood pulp as a main starting material on which is coated a coating solution containing a water-soluble binder and a cationic polymer fixing agent as main components and the coated paper has an ISO whiteness of not less than 95% and a fluorescence intensity of 7–15% measured by a method specified in JIS P-8148 using a xenon flash lamp as a light source, and thus the ISO whiteness of the recording paper is enhanced and an ink jet recording paper which is excellent in image density and color reproducibility of the recorded image and besides has a water resistance of the printed portion can be provided.

According to the second invention, an ink jet recording paper can be provided which is the ink jet recording paper having the above conditions in which calcium carbonate is used as a filler and the ash content of the base paper is not more than 20% measured in the same manner as specified in JIS P-8126, except that the incineration treatment is carried out at 500° C. for 4 hours.

According to the third invention, an ink jet recording paper which is high in ISO whiteness and surface strength, excellent in image density and color reproducibility of the recorded image and besides has a water resistance of the printed portion can be provided by specifying the fluorescent brightening agent (A) in the coating solution to be a diaminostilbene-disulfonic acid derivative and the cationic polymer fixing agent (B) to be a polyvinyl alcohol-cation monomer graft polymer, and mixing ratio A:B of coating amount in solid content to be within the range of 1:6–2:3.

What is claimed is:

1. An ink jet recording paper which comprises a neutral base paper comprising a wood pulp as a starting material on which is coated a coating solution consisting essentially of a diaminostilbene-disulfonic acid derivative (A) as a fluorescent brightening agent, a binder consisting of a water-soluble binder and water, and a graft copolymer of polyvinyl alcohol and polydiallyldimethyl-ammonium chloride (B) as a cationic polymer fixing agent, a mixing ratio A:B in solid coating amount being within the range of 1:6–2:3, said coated paper having an ISO brightness of not less than 95% and a fluorescence intensity of 7–15% measured by a method specified in JIS P-8148 using a xenon flash lamp as a light source.

2. An ink jet recording paper according to claim 1, wherein the neutral base paper is made using calcium carbonate as a filler and an ash content of the base paper is 5–20% measured in the same manner as specified in JIS P-8128, except that the incineration treatment is carried out at 500° for 4 hours.

3. An ink jet recording paper according to claim 1, wherein the coating solution is coated using an on-machine size press of a paper machine.

4. An ink jet recording paper according to claim 1, wherein the wood pulp contains a waste paper pulp.

5. An ink jet recording sheet according to claim 1, wherein the coating solution further contains a coloring dye or a coloring pigment.

* * * * *